US006094753A

United States Patent [19]

Korte

[11] Patent Number: 6,094,753

[45] Date of Patent: Aug. 1, 2000

[54] FLUSH VALVE WITH PARTIAL-FLUSH FUNCTION

[75] Inventor: Hermann Korte, Bad Oeynhausen, Germany

[73] Assignee: DAL-Georg Rost & Sohne Sanitaramaturen GmbH, Porta Westfalica, Germany

[21] Appl. No.: 09/176,162

[22] Filed: Oct. 21, 1998

[30] Foreign Application Priority Data

Nov. 4, 1997 [DE] Germany ..... 197 48 621

[51] Int. Cl.[7] ..... E03D 1/14

[52] U.S. Cl. ..... 4/325; 4/390

[58] Field of Search ..... 4/324, 325, 389, 4/390, 391

[56] References Cited

U.S. PATENT DOCUMENTS 5,265,282 11/1993 Schmucki ..... 4/325
5,305,474 4/1994 Nardi et al. ..... 4/324
5,720,053 2/1998 Menge ..... 4/325

*Primary Examiner*—Charles E. Phillips
*Attorney, Agent, or Firm*—Herbert Dubno; Andrew Wilford

[57] ABSTRACT

A flush valve has a valve ring defining a downwardly open valve port and an overflow tube centered on an upright axis and having a lower end seatable on the port. The tube is displaceable relative to the port between a lower closed position and an upper open position. Mechanism inside the tube can lift the tube into the open position and thereby allow water in the tank to move down and out through the port. A lower float vertically fixed in the tank is displaceable between a latching position and a releasing position and is constructed such that when submerged it normally assumes the latching position. A latch on the lower float engageable with the tube can hold the tube in the open position and can release the tube for movement into the closed position and ending of a flushing cycle. An upper float in the tank above the lower float has a part engageable with the lower float for displacing same into the releasing position on downward displacement of the upper float toward the lower float. A link displaceable between a coupling position preventing downward movement of the upper float and a decoupling position allows the upper float to move downward and a partial-flush actuating element is effective on the link for displacing same between the coupling and decoupling positions so that in the decoupling position downward floating of the upper float will displace the lower float into the releasing position and prematurely end a flushing cycle.

20 Claims, 14 Drawing Sheets

100
61
10
Ax11
7
61
121
42
34
3
41
60
451
65
4
46
64
638
40
43
21
210
2
22
33
20
14
1
12
611
62
340
13
45
620
450
630
661
6
66
63
50
500
5
51
40
32
47

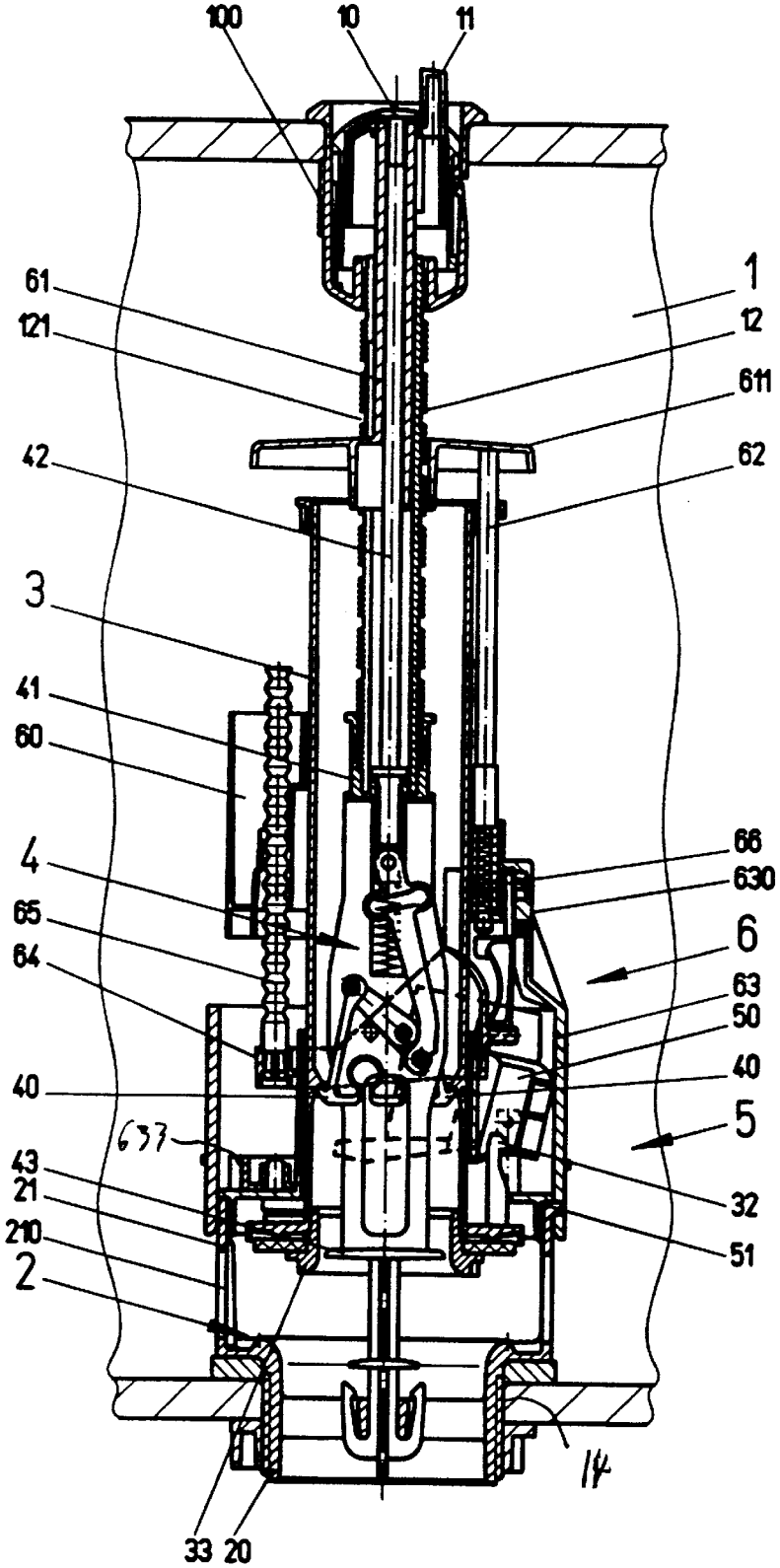
Fig.2
Fig.3
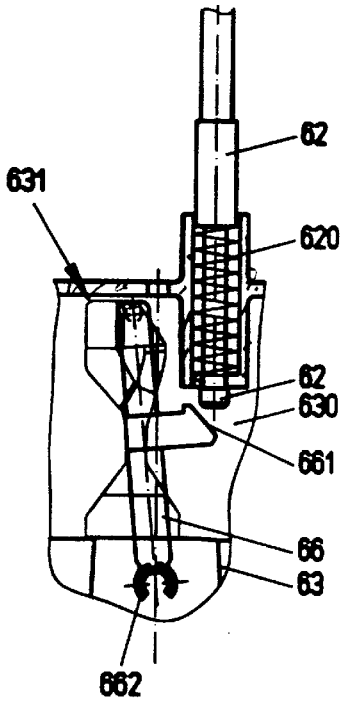

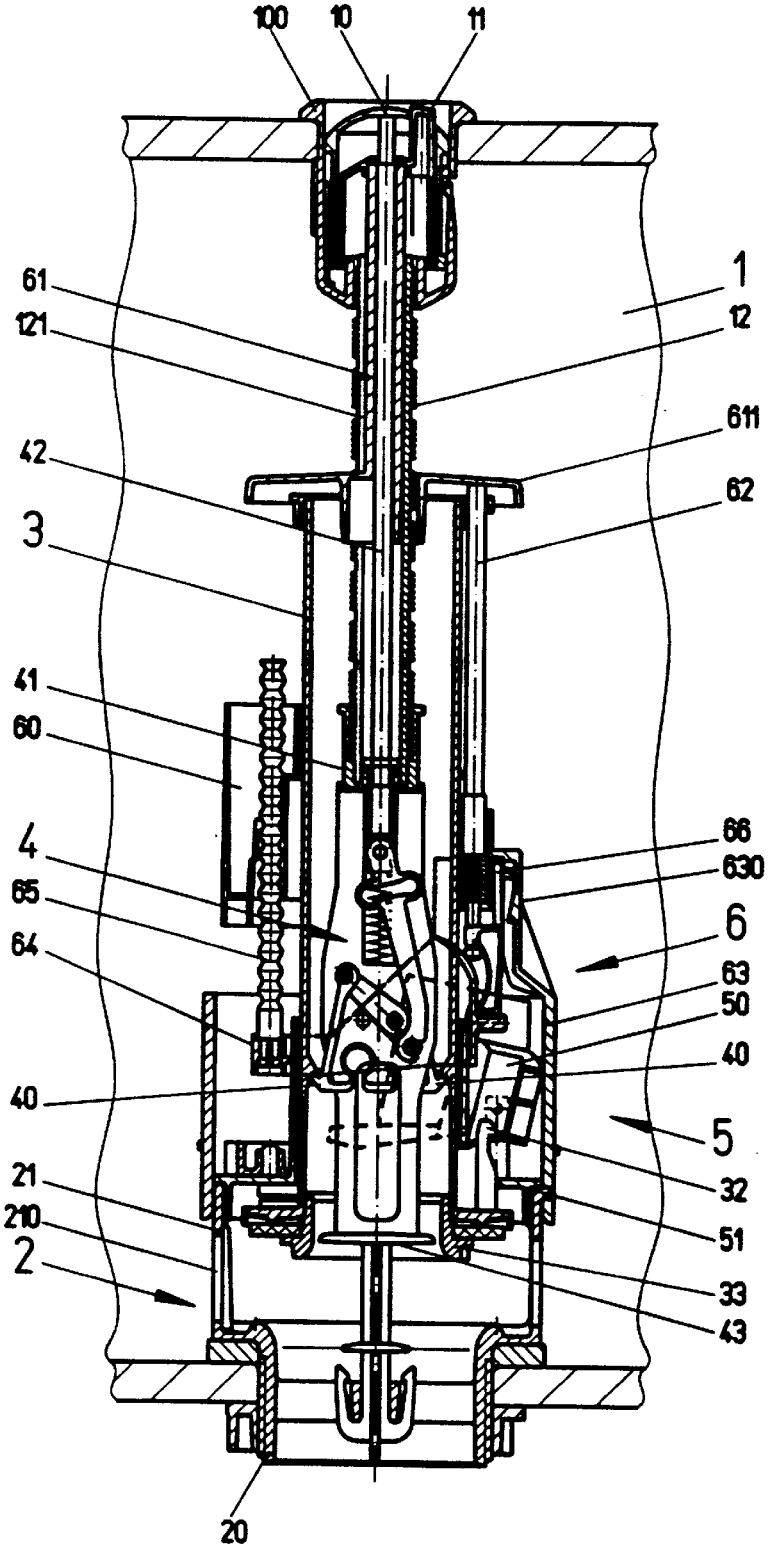
Fig.4
Fig.5
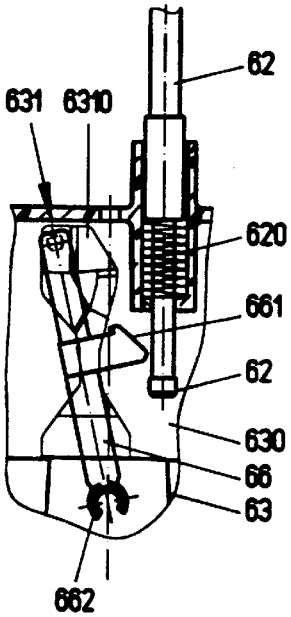

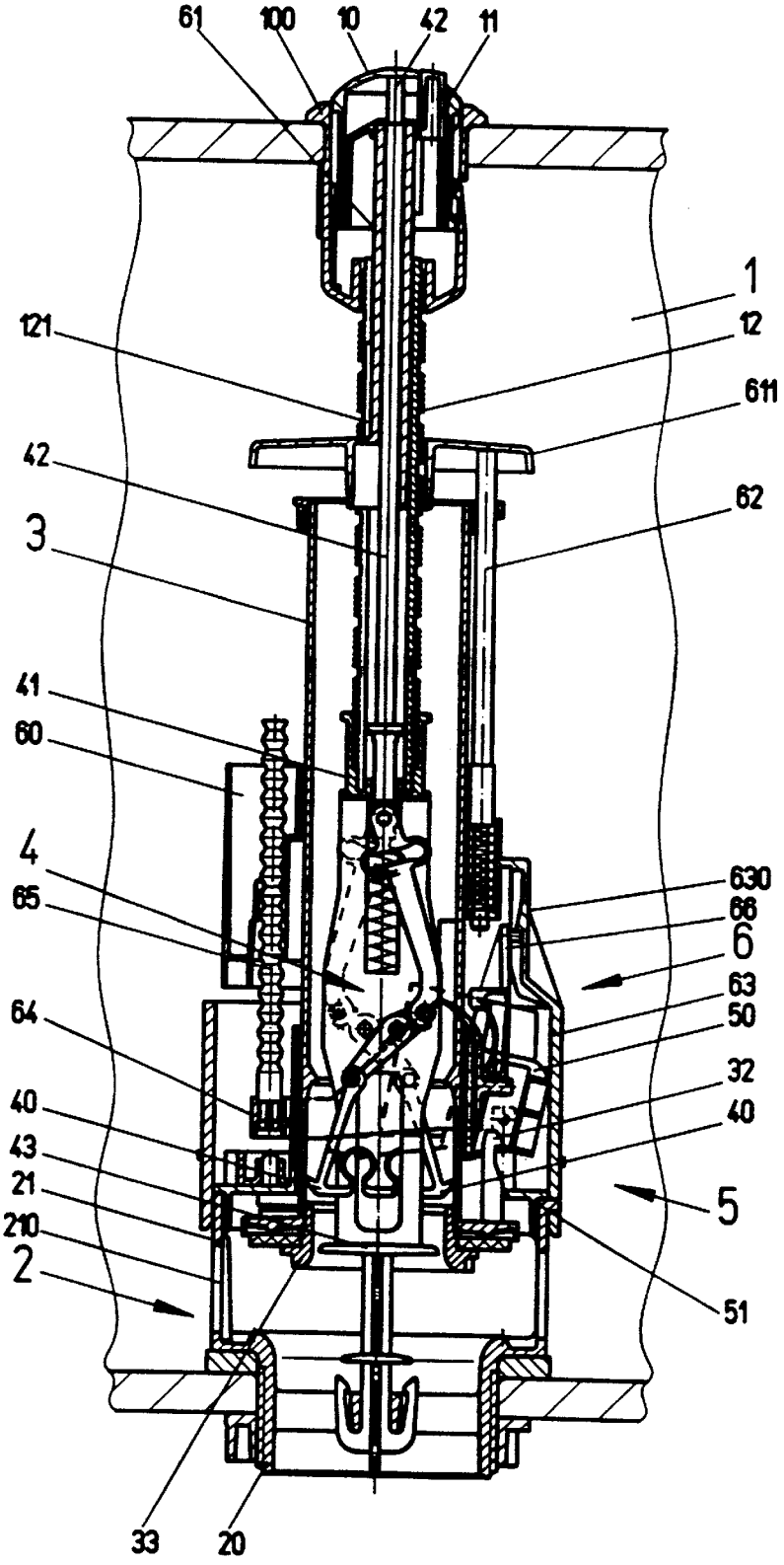
Fig.6
Fig.7
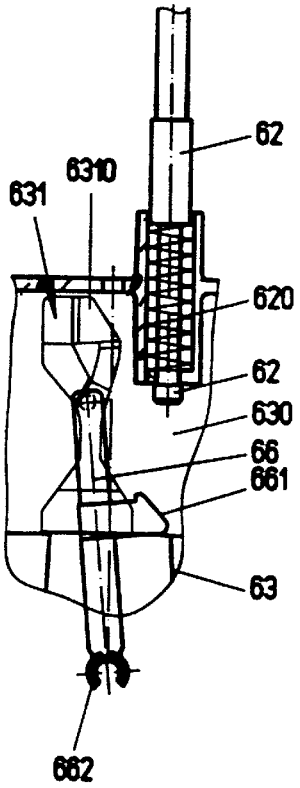

Fig. 9
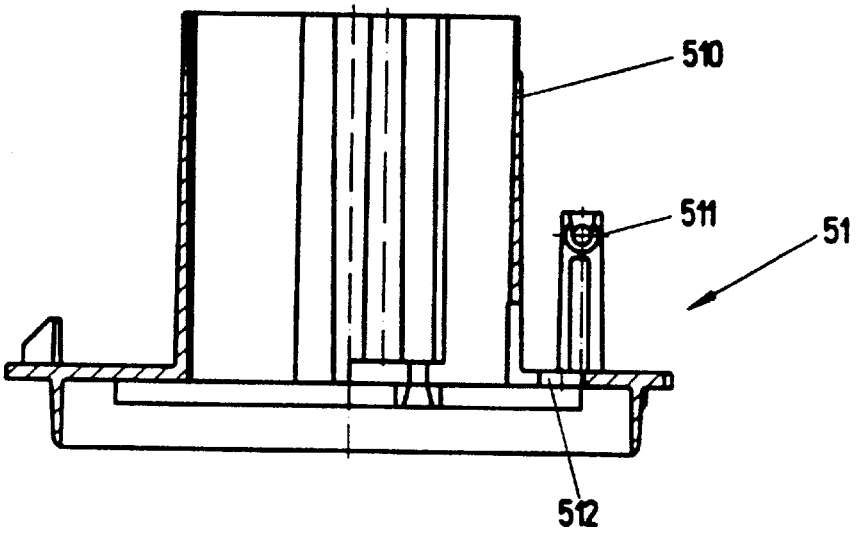
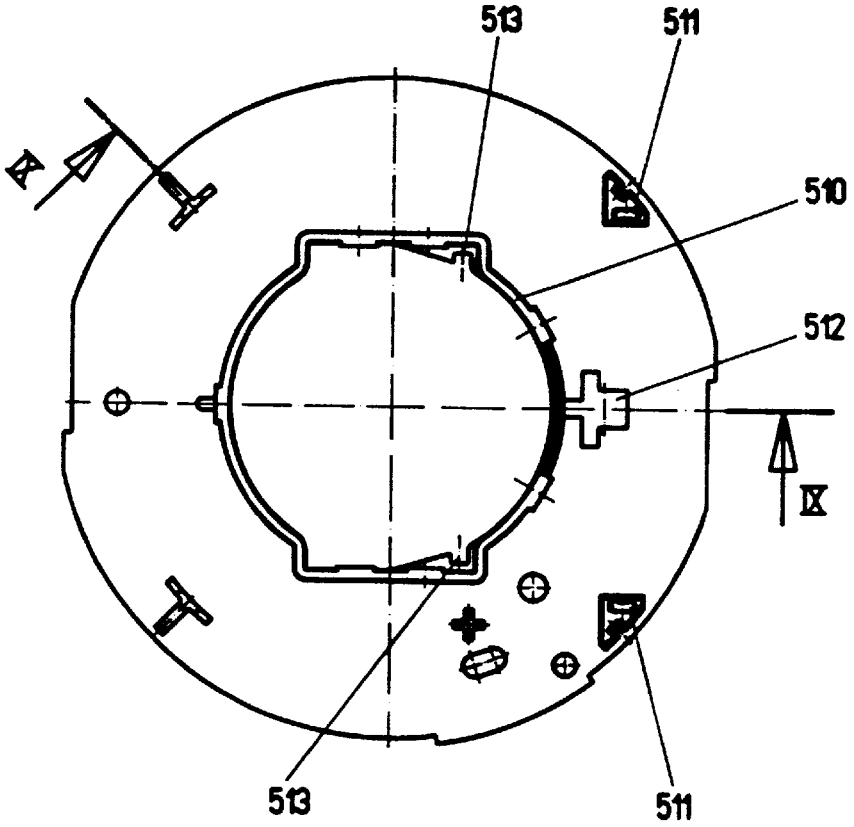
Fig. 10

Fig. 12
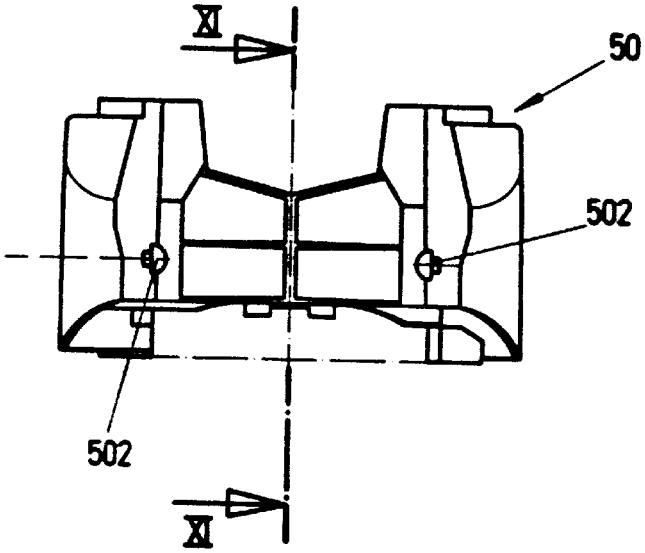
Fig. 11
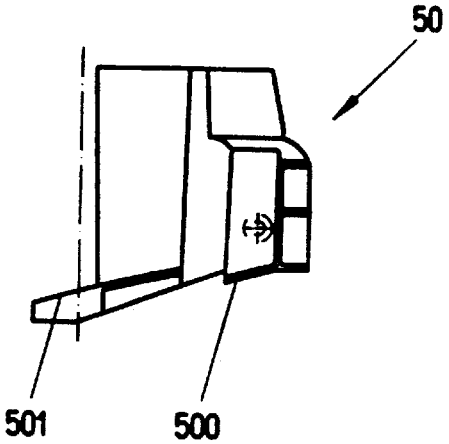
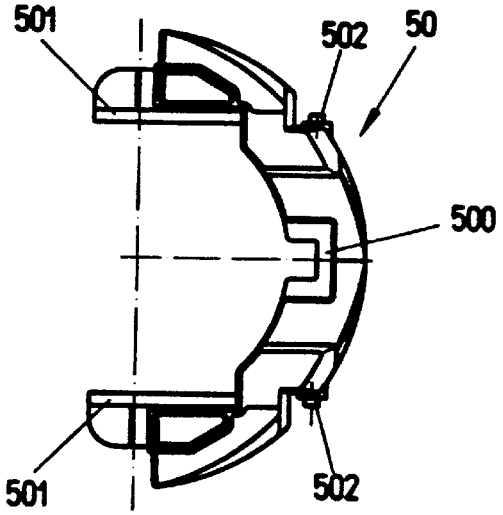
Fig. 13

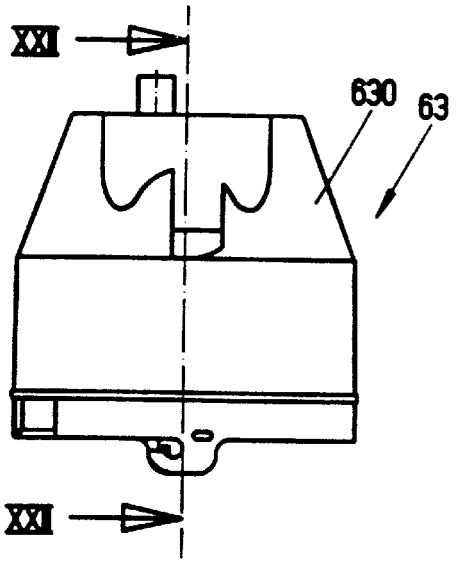
Fig. 23
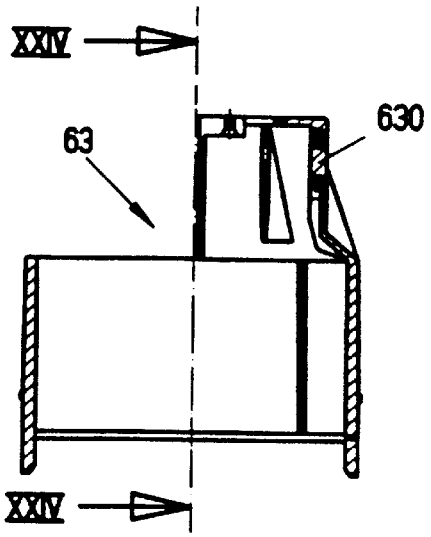
Fig. 22
Fig. 24
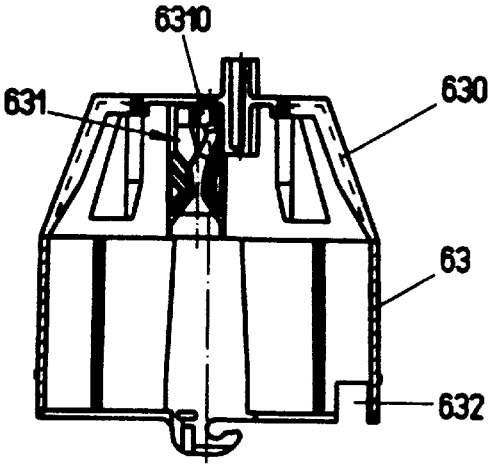
Fig. 26
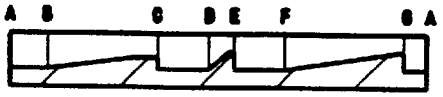
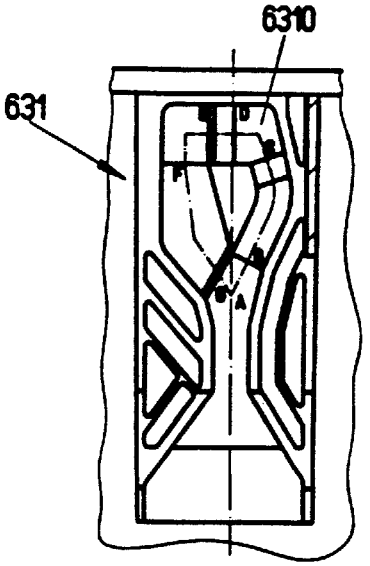
Fig. 25

Fig. 28
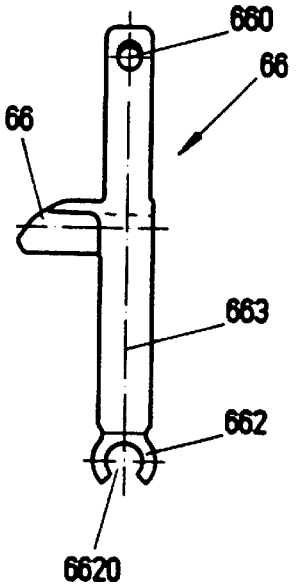
Fig. 27
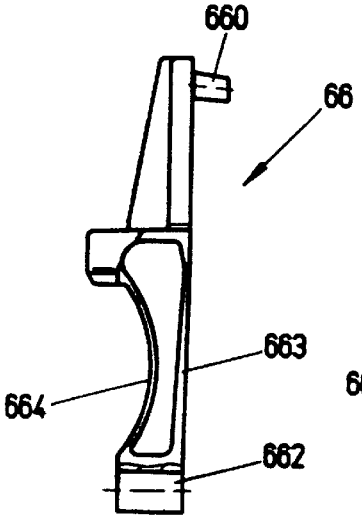
Fig. 29
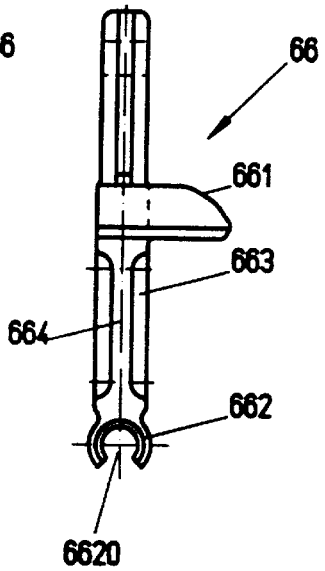
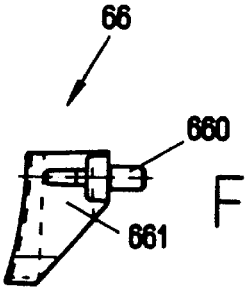
Fig. 30
Fig. 31
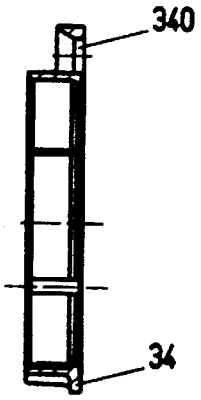
Fig. 32
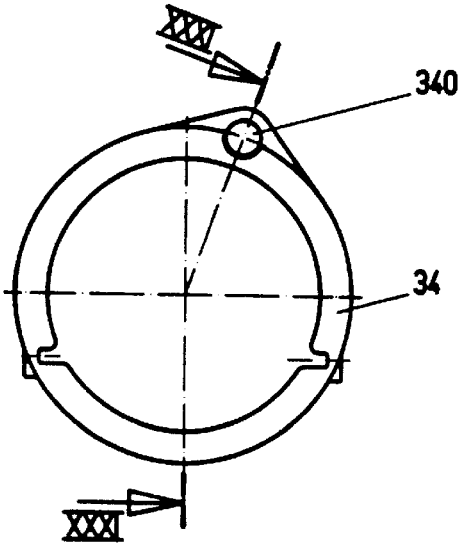

FLUSH VALVE WITH PARTIAL-FLUSH FUNCTION

FIELD OF THE INVENTION

The present invention relates to a flush valve. More particularly this invention concerns such a valve used in a toilet.

BACKGROUND OF THE INVENTION

A standard flush valve such as described in copending application Ser. No. 09/176,163 filed Oct. 21, 1998 has a valve ring defining a downwardly open valve port, an overflow tube centered on an upright axis and having a lower end opening into the valve port, and a valve body at the tube lower end displaceable relative to the port between a closed blocking position and an open position. Mechanism inside the tube lifts the valve body into the open position. A float in the tank adjacent the port cooperates with a latch system connected to the valve body for holding the body in the open position while the float is generally submerged. The tube is internally formed with an inwardly projecting ridge. The mechanism includes a frame inside the tube and fixed axially in the tank, at least one claw axially displaceable in the tube relative to the frame and engageable with the ridge, an actuating element accessible from outside the tank above the tube and axially aligned with the tube, and a direction-reversing linkage mounted on the frame and connected between the actuating element and the claw for raising the claw when the element is depressed.

Such a valve provides a standard full flush. It is however frequently desirable in order to conserve water to use substantially less than such a full flush.

OBJECTS OF THE INVENTION

It is therefore an object of the present invention to provide an improved flush valve with a partial-flush function.

Another object is the provision of such an improved flush valve with a partial-flush function which overcomes the above-given disadvantages, that is which allows the toilet to be flushed with large or small quantity of water at the user's selection.

A further object is to provide such a variable-flush valve which can alternately provide a full or partial flush and which is nonetheless of very simple and compact construction.

SUMMARY OF THE INVENTION

A flush valve has according to the invention a valve ring defining a downwardly open valve port and an overflow tube centered on an upright axis and having a lower end opening into the valve port and seatable on the port. The tube is displaceable relative to the port between a lower closed position blocking the port and an upper open position freeing the port. Mechanism inside the tube can lift the tube into the open position and thereby allow water in the tank to move down and out through the port. A lower float vertically fixed in the tank is displaceable between a latching position and a releasing position and is constructed such that when submerged it normally assumes the latching position. A latch on the lower float engageable with the tube can hold the tube in the open position while the lower float is in the latching position and can release the tube for movement into the closed position and ending of a flushing cycle when the lower float is in the releasing position. An upper float in the tank above the lower float has a part engageable with the lower float for displacing same into the releasing position on downward displacement of the upper float toward the lower float. A link displaceable between a coupling position preventing downward movement of the upper float and a decoupling position allows the upper float to move downward and a partial-flush actuating element is effective on the link for displacing same between the coupling and decoupling positions so that in the decoupling position downward floating of the upper float will displace the lower float into the releasing position and prematurely end a flushing cycle.

Thus with this system the flush valve can be operated to flush with a normal large quantity of water. When, however, the partial-flush element is depressed, the lower float is released prematurely to end the flushing cycle and, thereby, flush with a reduced quantity of water.

The flush valve wherein the tube is internally formed with an inwardly projecting ridge and the mechanism includes a frame inside the tube and fixed axially in the tank, at least one claw axially displaceable in the tube relative to the frame and engageable with the ridge, a full-flush actuating element accessible from outside the tank above the tube and axially aligned with the tube, and a direction-reversing linkage mounted on the frame and connected between the actuating element and the claw for raising the claw when the element is depressed. In addition the mechanism further has a tubular guide having a lower end fixed to the frame and an upper end provided with a guide for the actuating element, and a full-flush rod extending downward from the actuating element. The partial-flush actuating element is accessible from outside the tank adjacent the full-flush actuating element.

The tubular guide according to the invention is formed with a longitudinally extending slot and the partial-flush actuating element includes a tubular rod surrounding the full-flush rod and having an arm projecting through the slot, a link rod extending between the arm and the link means, and a spring urging the link rod against the arm. The valve ring is provided with an upwardly extending sleeve in which the tube is vertically slidable and on which the lower float is pivoted. The tube is formed with an upwardly directed hook forming part of the latch and engageable with the lower float.

The lower float in accordance with the invention is U-shaped, is pivotal about a horizontal axis between the latching and releasing positions, partially surrounds around the tube, and has an edge forming another part of the latch and engageable with the hook. In addition the upper float includes a carrier ring slidable along the tube above the lower float and the upper float is U-shaped and partially surrounds. The carrier ring is engageable with the lower float to tip into the releasing position on downward movement of the upper float and carrier ring relative to the lower float. This carrier ring is formed with an upwardly extending stem and the upper float is releasably secured to the stem and is movable limitedly therealong so that the relative spacings between the floats can be adjusted. Furthermore the carrier ring is formed with a pivot carrying a trip element forming part of the link means.

The sleeve according to the invention is formed with a cam groove forming another part of the link means and in which the trip element engages and the groove has an end region constructed such that when the trip element is engaged in the end groove the upper float cannot move downward. The partial-flush actuating element is engageable with the trip element to move it out of the end region. This groove is annular and is formed with one-way sawtooth steps. In addition the trip element is formed with an arm having an inclined flank operatively engageable with the partial-flush actuating element. An eye of the trip element gages over the pivot and the trip element is provided with an integral spring in the form of a pair of elastically flexible webs pressing an end of the trip element into the groove.

The full-flush actuating element and the partial-flush actuating element are immediately adjacent each other and the partial-flush actuating element is smaller than the full-flush actuating element. This makes it easy for the user to select full or partial flush. The frame is formed below the mechanism with a crosswise partition disk and the overflow tube has a lower end of reduced diameter generally complementary to that of the disk. The disk generally blocking flow through the overflow tube in the open position of the valve body.

BRIEF DESCRIPTION OF THE DRAWING

The above and other objects, features, and advantages will become more readily apparent from the following description, reference being made to the accompanying drawing in which:

FIG. 2 is a section like FIG. 1 but with the valve in the open and full-flush actuated position;

FIG. 3 is a large-scale view of a detail of FIG. 2 taken at 90° to the view plane of FIG. 2;

FIG. 4 is a section like FIG. 1 but with the valve in the open and partial-flush actuated position at the start of the flush;

FIG. 5 is a large-scale view of a detail of FIG. 4 taken at 90° to the view plane of FIG. 4;

FIG. 6 is a section like FIG. 4 but with the valve at the end of the partial-flush operation;

FIG. 7 is a large-scale view of a detail of FIG. 6 taken at 90° to view plane of FIG. 6;

FIG. 9 is a large-scale axial section through the middle part of the valve sleeve;

FIG. 10 is a top view of the valve sleeve, line IX—IX showing the section plane of FIG. 9;

FIG. 11 is a vertical section through the lower float;

FIG. 12 is a side view of the lower float, line XI—XI showing the section plane of FIG. 11;

FIG. 13 is a top view of the lower float;

FIG. 22 is a vertical section through the upper part of the valve sleeve;

FIG. 23 is a side view of the upper part of the valve sleeve, line XXII—XXII showing the section plane of FIG. 22;

FIG. 24 is a section taken along line XXIV—XXIV of FIG. 22;

FIG. 25 is a large-scale side view of the cam groove of the valve-sleeve upper part;

FIG. 26 is a developed side view illustrating the cam groove;

FIGS. 27, 28, 29, and 30 are front, side, back and top views of the partial-flush trip member;

FIG. 31 is a section through the guide ring of the invention;

FIG. 32 is a top view of the guide ring, line XXXI—XXXI showing the section lane of FIG. 31.

SPECIFIC DESCRIPTION

Figure 1:
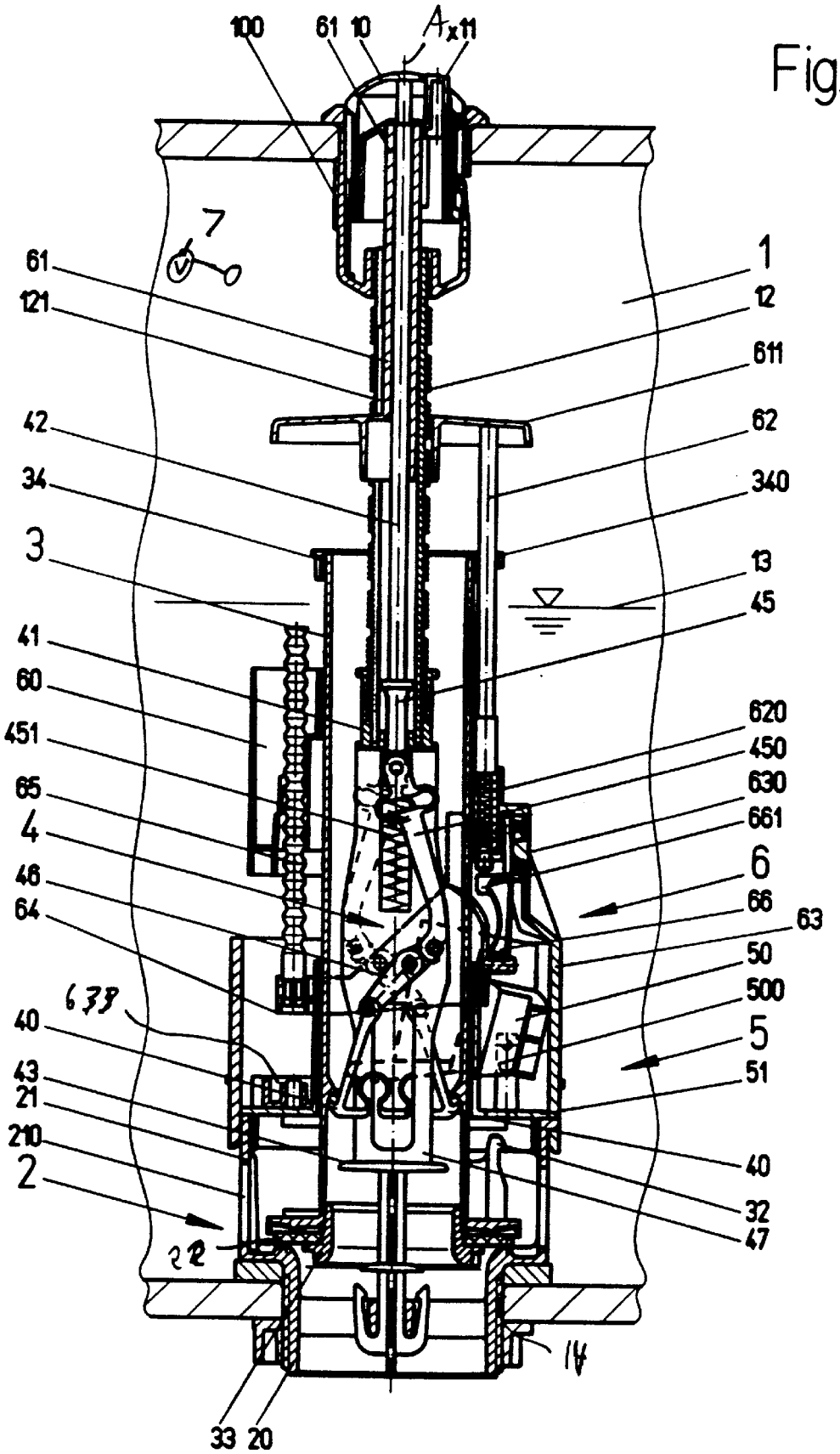
FIG 1 is a vertical section through the valve according to the invention in the closed and unactuated position.

As seen in FIG. 1 a toilet tank 1 normally filled to a level 13 with water is fitted in a port 14 in its bottom wall with a valve 2 normally holding the water in the tank 1, but openable to let it flow out through the port 14. An overflow tube 3 centered on an axis Ax has an upper end above the water level 13 and a lower end coaxial with and opening into the port 14. A mechanism 4 inside the tube 3 can be operated to open the valve 2. A float and latch system 5 serves to hold the valve 2 open until substantially all the water has flowed out of the tank 1. A partial-flush mechanism 6 is provided to reduce the amount of water released from the tank 1. A float-controlled fill valve indicated schematically at 7 serves to fill the tank 1.

The valve 2 basically comprises a stepped sleeve 20 having an externally threaded small-diameter collar that passes through the port 14 where it is secured by a nut and a wider upper wall or collar 21 formed with an array of apertures or holes 210 permitting free flow radially through the wall 21. In addition the sleeve 20 forms an upwardly directed annular seat 22 centered on the axis Ax.

Figure 8:
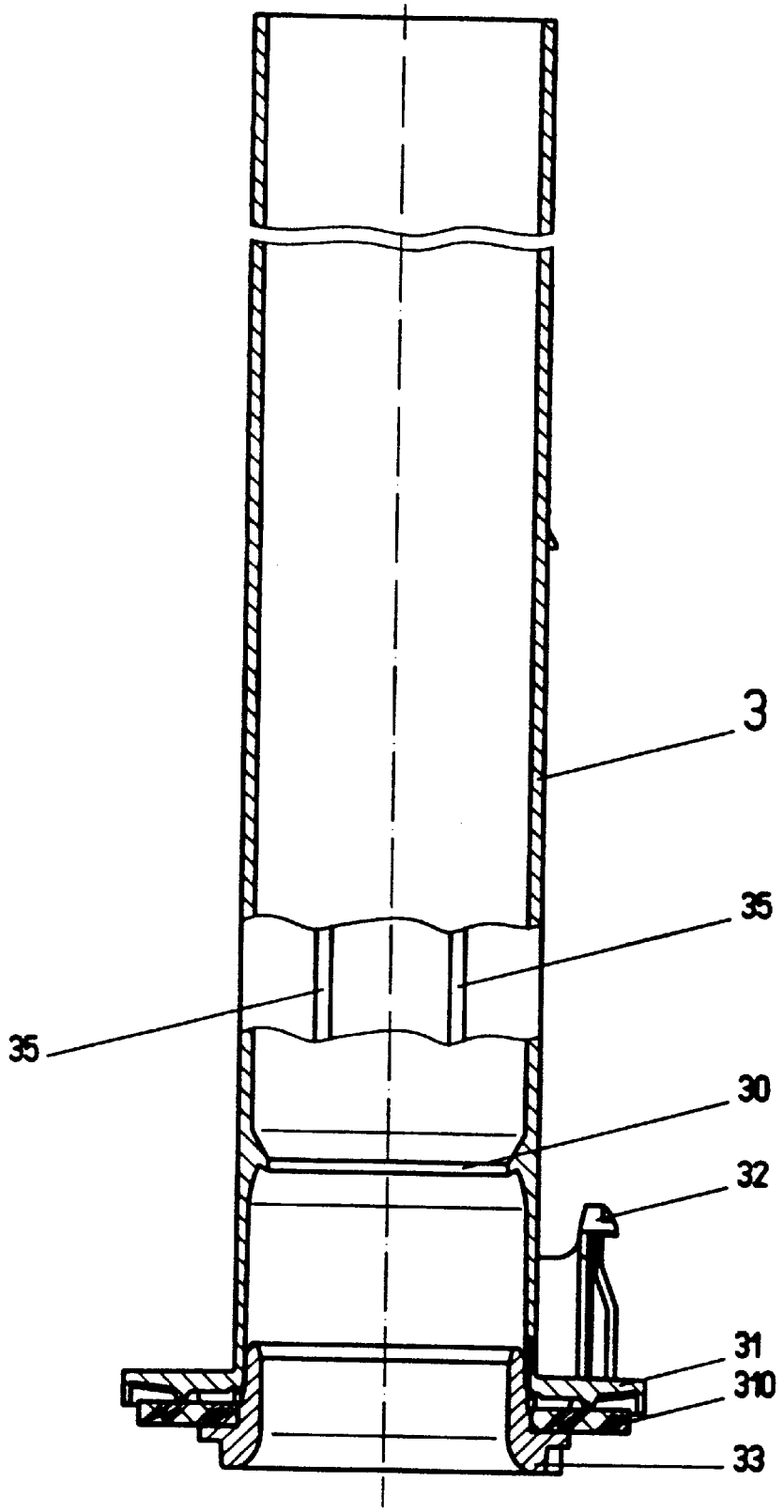
FIG. 8 is a large-scale axial section through the overflow tube.
Figure 14:
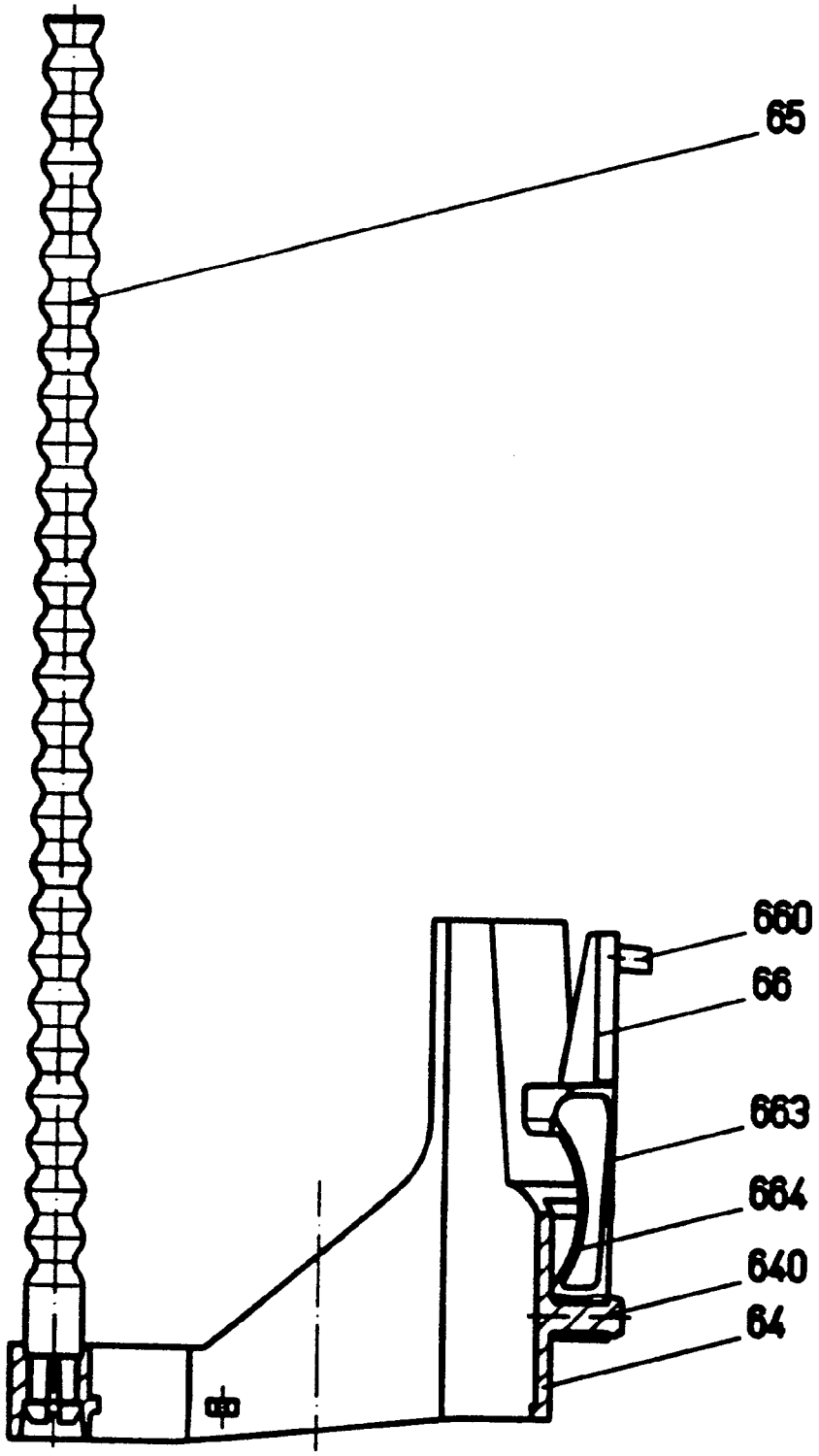
FIG. 14 is a side view of the secondary-float carrier assembly.
Figure 15:
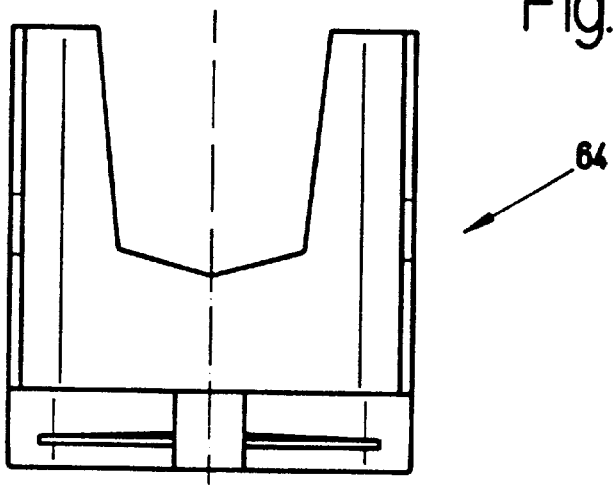
FIG. 15 is a side view of the secondary-float carrier body.
Figure 16:
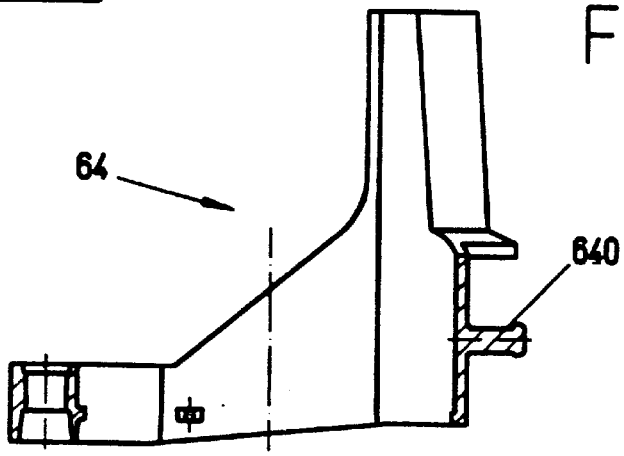
FIG. 16 is a vertical section through the secondary-float carrier body.
Figure 17:
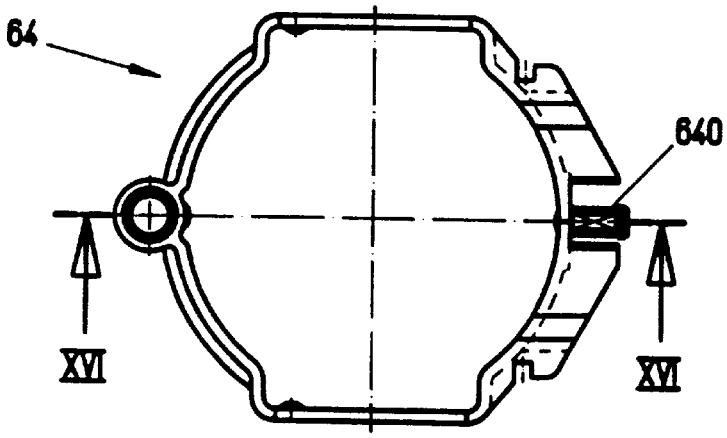
FIG. 17 is a top view of the secondary-float carrier body, line XVI—XVI showing the section plane of FIG. 16.

As seen in FIG. 8 the overflow tube 3 has a lower end formed with a radially outwardly directed flange 31 on the bottom of which is an elastomeric washer 310 engageable with the annular valve seat 22 and held in place by a ring 33. Thus when this tube 3 is sitting on the valve seat 22, the only flow down through the port 14 is through the tube 3 itself, when the water level 13 is over the top of this tube 3. In addition this tube 3 is formed internally with a downwardly hooked ridge 30 and with external axially extending ridges 34. A hook 32 extends axially upward from the flange 31.

The valve mechanism 4 has an actuating element or button 10 in a sleeve 100 itself mounted in the top wall of the tank and connected via a threaded and axially slotted sleeve 12 to a threaded seat 41 of a mechanism frame or holder 47 fixed to the sleeve 20. A rod 42 extending through the sleeve 12 connects the button 10 with a plunger 45 axially displaceable in the frame 47 and urged upward therein by a spring 451 braced between the frame 47 and a stem projecting from a lower end of the plunger 45. This button 10 is pressed downward from the FIG. 1 unactuated position to the FIG. 2 actuated position to flush the toilet equipped with the flush valve of this invention with a full or standard flush as described in more detail below. A pair of two-arm lever 46 pivoted on the frame 47 have upper ends connected via links 450 to the lower end of the plunger 45 and lower ends connected to arms of a double-claw element 40 that can engage under the ridge 30. The lower end of the frame 47 is formed with a blocking disk 43 that fits closely in the ring 33 to prevent water from rising in the tube 3 during a flushing cycle.

The float and latch system 5 comprises as shown in FIGS. 9 and 10 a middle sleeve-like element 51 that sits snugly in the upper end of the valve sleeve 20 and that has a center collar 510 that slidingly engages around the overflow tube 3 and is formed with grooves 513 that slidingly receive the ribs 34 to prevent this tube 3 from rotating about its axis Ax in the element 51 while permitting it to move axially. Thus this collar 510 acts as an axial guide for the axial movement of the slidable tube 3. In addition the lower element 51 carries a pair of pivots 511 that support the gudgeons 502 of a U-shaped lower float 50 (See FIGS. 11–13) formed with a lip 500 that can engage under the hook 32 (FIG. 8) of the overflow tube 3 and with a pair of actuating formations or extensions 50. The element 51 is formed with a throughgoing hole 512 that can snugly fit around the hook 32 of the tube 3 in a raised position thereof described below.

Figure 33:
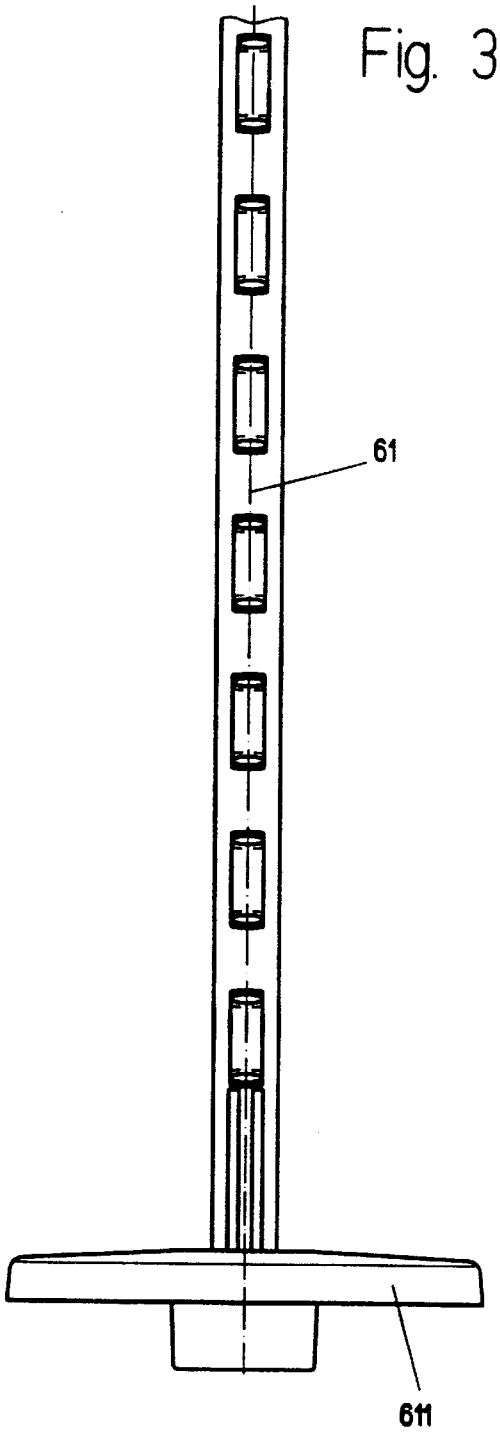
FIGS. 33 and 34 are side and bottom views of part of the secondary-flush actuating assembly.
Figure 34:
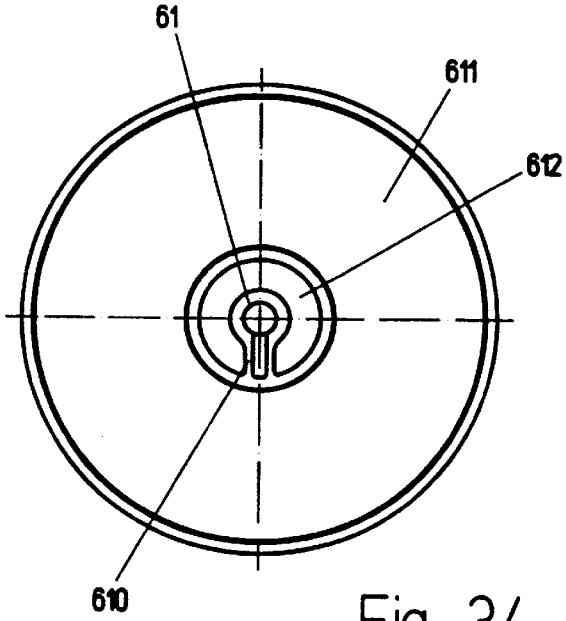

The partial-flush mechanism 6 comprises a secondary actuating element or button 11 that is substantially smaller than the button 10 and that is also vertically displaceable adjacent the button 10 in the guide 100. This button 11 is connected to a tubular actuating rod 61 surrounding the rod 42 and as shown in FIGS. 33 and 34 having a radially projecting arm 610 extending out through an axially extending slot 121 in the tube 12 and connected to a collar 611 bearing on the upper end of a push rod 62 vertically displaceable in a hole 340 of a guide ring 34 (FIGS. 31 and 32) carried on the upper end of the tube 3. Thus the tubular rod 61 is axially guided on the rod 61 and forms an opening 612 through which the slotted tube 12 passes. An upper sleeve 63 fitted atop the intermediate sleeve 51 has as shown in FIGS. 21–26 a tapered upper portion 630 provided with a vertical cam groove 631 having an upper region 6310 and six steps A–G in a pair of joined paths A-B-C-D and E-F-G. The lower end of the rod 62 is vertically reciprocal in the sleeve 63 and urged upward therein by a spring 620.

Figure 19:
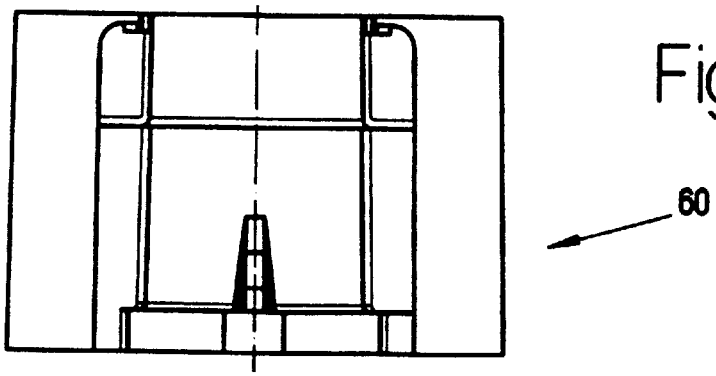
FIGS. 18 and 19 are top and side views of the upper float.
Figure 18:
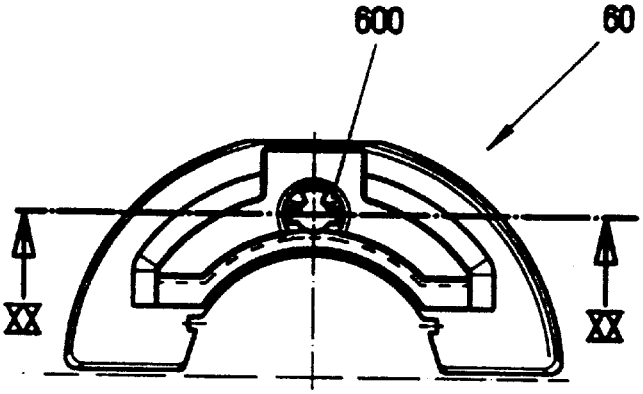
Figure 20:
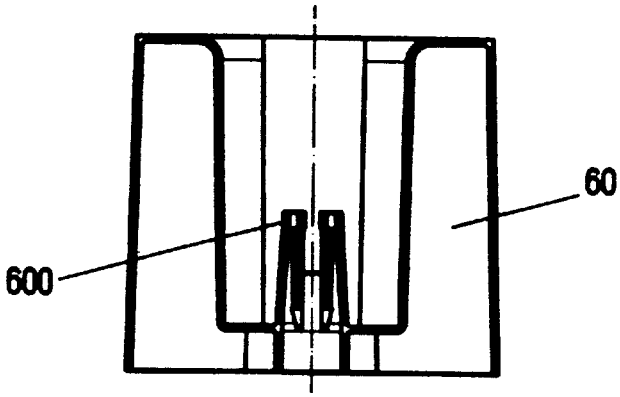
FIG. 20 is a section taken along line XX—XX of FIG. 18.
Figure 21:
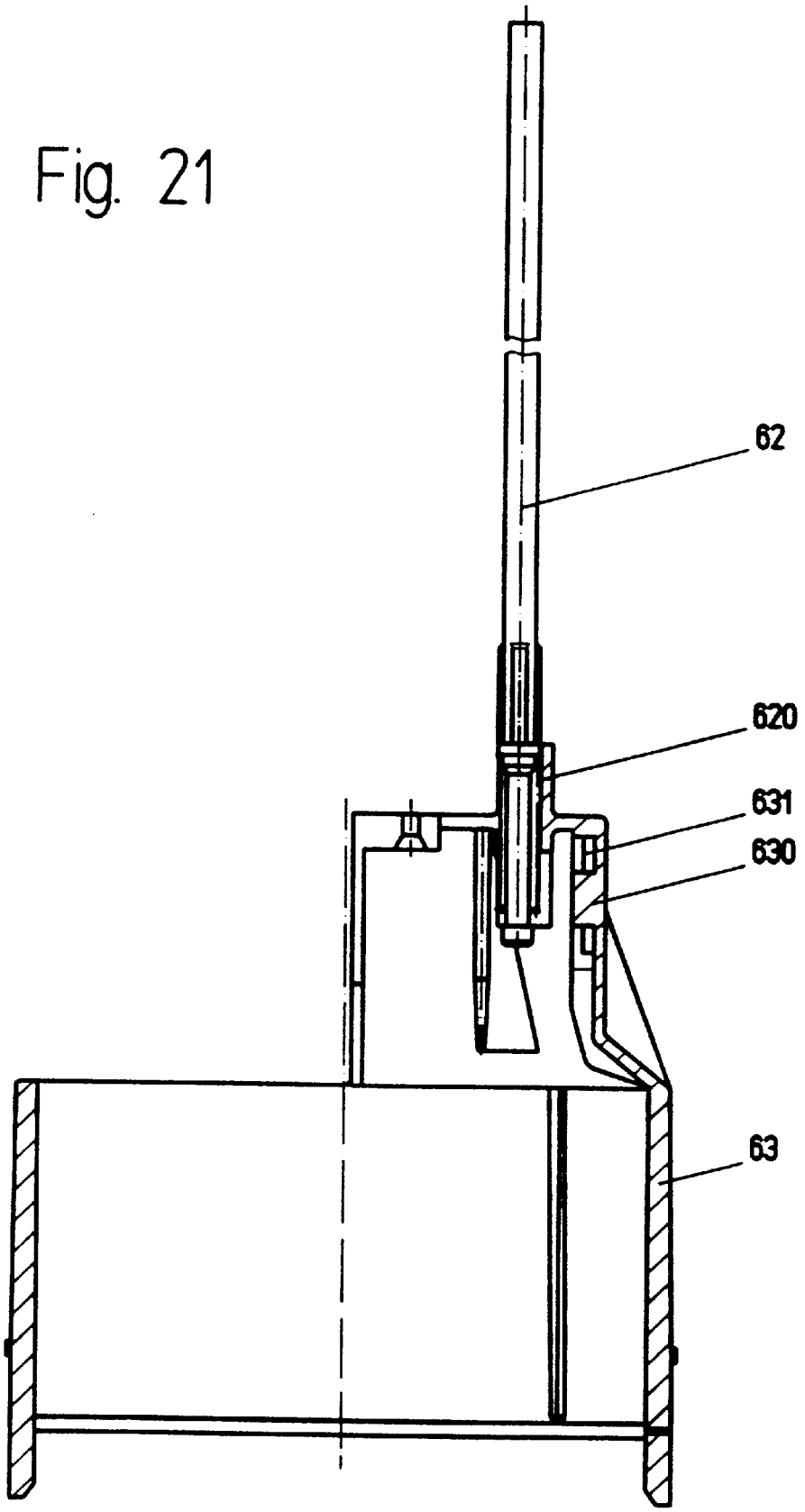
FIG. 21 is a vertical section through the upper part of the valve sleeve and associated structure.

An upper float 60 shown in FIGS. 18–20 is also U-shaped and surrounds half the tube 3 opposite the float 50. It has a hole 600 that fits snugly around a ridged vertical rod 65 so that it can be moved up and down and arrested at any position therealong. This rod 65 is seated at its lower end in a carrier body or ring 64 shown in more detail in FIGS. 14–17 that is shaped to fit complementarily around the tube 3 and slide easily therealong inside the upper sleeve 63 and that is engageable with the formations 501 of the float 50 as will be described below. On its side opposite the rod 65, the ring 64 has a radially projecting pivot 640 that is snap fitted in an eye 662 formed with a slot 6620 of a lower end of a cam-following trip member 66 shown in FIGS. 27–30. This member 66 is formed at its end opposite the eye 662 with a cam-follower pin 660 that engages in the cam groove 631 and is also formed with a laterally projecting arm having an actuating ramp 661 engageable with the lower end of the rod 62. The half of the member 66 forming the eye 662 is constituted as a pair of thin plastic webs 663 and 664 that are springy so that the pin 660 is urged elastically radially into the groove 631, as when relaxed the thinner outer web 664 is straight, but in use is curved and under stress. The steps A–G of the cam 631 are angled such that the pin 660 can only move in one direction along its annular path, and, when between the steps C and D in the portion 6310, the member 66 vertically couples the ring 64 and upper float 60 to the sleeve 51 carrying the lower float 50.

The lower edge of the sleeve 63 is formed with a slot 632 that can be covered by a wheel 633 that can therefore establish the rate with which water can run out of the sleeve 63 and, therefore, the size of the flush.

This valve operates a follows:

Normally as shown in FIG. 1 the overflow tube 3, whose lower end acts as a valve body, is sitting atop the seat 22. The sleeve 20 is filled with water as is the sleeve 63. The float 50 is tipped back and the upper float 60 is in an upper position as illustrated.

When the button 10 is pushed axially downward as shown in FIG. 2 without pushing down the smaller button 11, to achieve a full or standard flush, this movement is transmitted by the rod 42 to the plunger 45 which in turn pushes down the links 450 to pivot the levers 46 and raise the double claw 40 that catches under the ridge 30 of the tube 3 to lift this tube 3 off the seat 22. Water will therefore rush through the apertures 210 and out through the port 14. As the tube 3 is lifted the hook 32 will catch on the lip 500 of the float 50 and hang up there so that when the button 10 is released, the tube 3 will be held in the upper open position as shown in FIG. 2 so long as the water level in the upper sleeve 63 is high enough to hold the float 50 in the position of FIG. 1. The trip element 55 is in the position of FIG. 3 so that the pin 660 is caught in the zone 6310 and the upper float 60 is held in the illustrated upper position and has no effect on the flushing operation, that is the actuator ring 64 is held up out of contact with the float formations 501.

As the water runs out of the system the upper sleeve 63 will slowly drain through the slot 632 at a rate determined by the setting of the wheel 633. Once the sleeve 63 is substantially empty, the float 50 will pivot back down and pull its lip 500 out from underneath the hook 32, allowing the tube 3 to drop back down into the position of FIG. 1. This action takes place when the tank 1 is substantially empty and serves to block the port 14.

Meanwhile of course the standard float-controlled valve 7 is pouring water into the tank 1, but at a much slower rate than that at which it is exiting the tank 1 via the port 14, so that once the tube 3 drops back down, the tank 1 will refill until it reaches the level 13, whereupon the valve 7 will close. If for some reason the tank 1 continues to fill, once the liquid level reaches the top of the tube 3, it can flow down this tube 3 into the toilet, avoiding an overflow outside the fixture.

For a partial flush the user depresses both the buttons 10 and 11. This action pushes down the rod 62 to move the trip member 66 over so that it in effect decouples the upper float 60 from the sleeve 51 carrying the lower float 50. To start with the tube 3 will lift and the tank 3 will drain through the port 14 as described above.

Once, however, the water level drops such that the upper float 60 is no longer floating, this float 60, which is no longer prevented from descending by engagement of the pin 660 in the zone 6310 as shown in FIG. 7, drops with its ring 64 and engages the formations 501 of the float 50 as shown in FIG. 6, pivoting it up and releasing the hook 32 from the formations 500. As the ring 64 drops relative to the sleeve 63, the pin 660 of the trip member 66 slides down along the path E-F-G in the slot 631. This causes the tube 3 to drop back down, even through the float 50 is still submerged, thereby truncating the flush operation.

Once the flush operation is stopped and the tank refills, the rising water will again lift the float 60, causing the pin 660 to be pulled back along the path A-B-C-D in the slot 631, returning to the coupling position 6310. This restores the parts to their starting position.

Thus the user can choose a full flush using substantially all the contents of the tank 10, which is done by pressing only the larger button 10. If, however, a smaller flush is all that is needed, both buttons 10 and 11 are depressed and a substantially smaller amount of water is released for a partial flush.

I claim:

1. A flush valve for use on a tank, the flush valve comprising:

a valve ring defining a downwardly open valve port;

an overflow tube centered on an upright axis and having a lower end opening into the valve port and seatable on the port, the tube being displaceable relative to the port between a lower closed position blocking the port and an upper open position freeing the port;

means including a mechanism inside the tube for lifting the tube into the open position and for thereby allowing water in the tank to move down and out through the port;

a lower float vertically fixed in the tank and displaceable between a latching position and a releasing position, the lower float being constructed such that when submerged it normally assumes the latching position;

means including a latch on the lower float engageable with the tube for holding the tube in the open position while the lower float is in the latching position and for releasing the tube for movement into the closed position and ending of a flushing cycle when the lower float is in the releasing position;

an upper float in the tank above the lower float;

actuating means on the upper float engageable with the lower float for displacing same into the releasing position on downward displacement of the upper float toward the lower float;

link means displaceable between a coupling position preventing downward movement of the upper float and a decoupling position allowing the upper float to move downward; and means including a partial-flush actuating element effective on the link means for displacing same between the coupling and decoupling positions, whereby in the decoupling position downward floating of the upper float will displace the lower float into the releasing position and prematurely end a flushing cycle.

2. The flush valve defined in claim 1 wherein the tube is internally formed with an inwardly projecting ridge, the mechanism including a frame inside the tube and fixed axially in the tank, at least one claw axially displaceable in the tube relative to the frame and engageable with the ridge, a full-flush actuating element accessible from outside the tank above the tube and axially aligned with the tube, and a direction-reversing linkage mounted on the frame and connected between the actuating element and the claw for raising the claw when the element is depressed.

3. The flush valve defined in claim 2 wherein the mechanism further includes a tubular guide having a lower end fixed to the frame and an upper end provided with a guide for the actuating element, and a full-flush rod extending downward from the actuating element, the partial-flush actuating element being accessible from outside the tank adjacent the full-flush actuating element.

4. The flush valve defined in claim 3 wherein the tubular guide is formed with a longitudinally extending slot and the partial-flush actuating element includes a tubular rod surrounding the full-flush rod and having an arm projecting through the slot, a link rod extending between the arm and the link means, and a spring urging the link rod against the arm.

5. The flush valve defined in claim 1 wherein the valve ring is provided with an upwardly extending sleeve in which the tube is vertically slidable and on which the lower float is pivoted, the tube being formed with an upwardly directed hook forming part of the latch and engageable with the lower float.

6. The flush valve defined in claim 5 wherein the lower float is U-shaped, is pivotal about a horizontal axis between the latching and releasing positions, partially surrounds around the tube, and has an edge forming another part of the latch and engageable with the hook.

7. The flush valve defined in claim 6 wherein upper float includes a carrier ring slidable along the tube above the lower float and the upper float is U-shaped and partially surrounds, the carrier ring being engageable with the lower float to tip into the releasing position on downward movement of the upper float and carrier ring relative to the lower float.

8. The flush valve defined in claim 7 wherein the carrier ring is formed with an upwardly extending stem and the upper float is releasably secured to the stem and is movable limitedly therealong, whereby the relative spacings between the floats can be adjusted.

9. The flush valve defined in claim 7 wherein the carrier ring is formed with a pivot carrying a trip element forming part of the link means.

10. The flush valve defined in claim 9 wherein the sleeve is formed with a cam groove forming another part of the link means and in which the trip element engages and the groove has an end region constructed such that when the trip element is engaged in the end groove the upper float cannot move downward, the partial-flush actuating element being engageable with the trip element to move it out of the end region.

11. The flush valve defined in claim 10 wherein the groove is annular and is formed with one-way sawtooth steps.

12. The flush valve defined in claim 11 wherein the trip element is formed with an arm having an inclined flank operatively engageable with the partial-flush actuating element.

13. The flush valve defined in claim 12 wherein the trip element is formed with an eye engaged over the pivot.

14. The flush valve defined in claim 11 wherein the trip element is provided with spring means urging it into contact with the steps of the groove.

15. The flush valve defined in claim 14 wherein the spring means includes a pair of elastically flexible webs pressing an end of the trip element into the groove.

16. The flush valve defined in claim 2 wherein the full-flush actuating element and the partial-flush actuating element are immediately adjacent each other and the partial-flush actuating element is smaller than the full-flush actuating element.

17. The flush valve defined in claim 1 wherein the frame is formed below the mechanism with a crosswise partition disk and the overflow tube has a lower end of reduced diameter generally complementary to that of the disk, the disk generally blocking flow through the overflow tube in the open position of the valve body.

18. The flush valve defined in claim 1 wherein the overflow has at its lower end an outwardly projecting flange forming a valve body engageable with the valve ring.

19. The flush valve defined in claim 1 wherein the mechanism is fixed to the valve ring and axially displaceable relative to the overflow tube.

20. The flush valve defined in claim 1 wherein the mechanism includes at least one claw axially displaceable in the tube relative to the frame and engageable with the ridge, an actuating button accessible from outside the tank above the tube and axially aligned with the tube, and a direction-reversing linkage mounted on the frame and connected between the actuating button and the claw for raising the claw when the button is depressed.

* * * * *